United States Patent [19]

Rathbone

[11] Patent Number: 4,962,646

[45] Date of Patent: Oct. 16, 1990

[54] AIR SEPARATION

[75] Inventor: Thomas Rathbone, Farnham, United Kingdom

[73] Assignee: The BOC Group, Inc., New Providence, N.J.

[21] Appl. No.: 400,319

[22] Filed: Aug. 30, 1989

[30] Foreign Application Priority Data

Aug. 31, 1988 [GB] United Kingdom ..... 8820582

[51] Int. Cl.[5] ..... F25J 3/02

[52] U.S. Cl. ..... 62/24; 60/39.33; 62/40

[58] Field of Search ..... 60/39.02, 39.33; 62/9, 62/11, 13, 23, 24, 40

[56] References Cited

U.S. PATENT DOCUMENTS 3,394,555 7/1968 LaFleur ..... 62/40
4,072,023 2/1978 Springmann ..... 62/13
4,092,662 3/1980 Ogata et al. ..... 62/40
4,704,147 11/1987 Kleinberg ..... 62/24

FOREIGN PATENT DOCUMENTS 0211335 2/1987 European Pat. Off. .
0286314 10/1988 European Pat. Off. .
1199293 8/1965 Fed. Rep. of Germany .
2182785 12/1973 France .
2305700 10/1976 France .

*Primary Examiner*—Ronald C. Capossela
*Attorney, Agent, or Firm*—Robert I. Pearlman; Carol A. Nemetz; David M. Rosenblum

[57] ABSTRACT

A method and apparatus for cryogenic air separation wherein both fuel gas and electrical power are produced. Respective operating pressures of the lower and higher pressure rectification columns can be set independently of one another, allowing flexibility in selecting the purity of the oxygen product.

22 Claims, 3 Drawing Sheets

AIR SEPARATION

TECHNICAL FIELD

This invention relates to a method and apparatus for separating air and to the use of such method and apparatus in cycles which use an oxygen product from the air separation in a chemical reaction, for example oxidation (including combustion) and in which electrical power is also generated.

BACKGROUND OF THE PRIOR ART

There is an increasing demand for cryogenic air separation plants to produce very large quantities of oxygen for use for example in direct reduction steel making processes, coal gasification processes, and partial oxidation processes in which natural gas is converted to synthetic gas.

Most modern commercial air separation plants employ a higher pressure rectification column having its upper end in heat exchange relationship with the lower end of the lower pressure rectification column. Cold compressed air is separated into oxygen-enriched and nitrogen-enriched liquids in the higher pressure column, and these liquids are transferred to the lower pressure column for separation into nitrogen-rich and oxygen-rich products. Large quantities of energy are required to compress the feed air. U.S. Pat. No. 3,731,495 discloses a process for reducing the external power consumption of the process. The process employs a nitrogen-quenched power turbine. A portion of the compressed feed air is mixed with fuel and combusted. A hot combustion mixture is then quenched with waste nitrogen-rich gas from the lower pressure rectification column and the resulting gaseous mixture is expanded in a power turbine. The expansion provides energy to compress the feed air to the system. A major disadvantage of this process is that the pressure of the gaseous mixture expanded in the power turbine can be no higher than that of the waste nitrogen mixed with the combustion gases. As pointed out in U.S. Pat. No. 4,224,045, commercially available power turbines have optimum inlet pressures in excess of the optimum operating pressure of the lower pressure rectification column. Accordingly, U.S. Pat. No. 4,224,045 proposes compressing the waste nitrogen prior to using it to quench the combustion mixture.

In both these U.S. patent specifications, the turbine is employed primarily to produce a quantity of external work which is sufficient to meet the requirement of the air compressor. However, when large quantities of oxygen are required for processes such as direct reduction steel making or coal gasification it is desirable to use the turbine to generate a quantity of electricity greatly in excess of the demands of the air compressor. Accordingly the air compressor feeds both the air separation plant and the turbine. The air so supplied to the turbine is typically used to support the combustion of fuel gas from the gasifier or blast furnace. In the process disclosed in U.S. Pat. No. 4,224,045 the pressure at which the air feed compressor operates is substantially the same as that of the operating pressure of the higher pressure rectification column and is selected so as to maximise the efficiency of the higher pressure column. However, in the kind of process described above where the air also feeds the combustion chamber of the power station, the pressure to which the air is compressed will be governed by the inlet pressure selected for the turbine. Typically, such turbines are operated at relatively high pressures above the optimum operating pressure of the high pressure column in a conventional double rectification apparatus. Indeed, with the upper end of the higher pressure column in heat exchange relationship with the lower end of the lower pressure column through a condenser reboiler, selecting the pressure for the higher pressure column effectively dictates what the pressure is in the lower pressure column and what the reflux ratios are in both columns. This inflexibility makes it difficult to achieve efficient operation of the two columns.

In U.S. Pat. No. 4,655,809 there is disclosed a process in which the oxygen and waste nitrogen streams are generated by an air separation apparatus including only one rectification column. In order to provide reflux and reboil for the rectification column it is necessary to operate a heat pump cycle. However, to operate the rectification column at substantially the same pressure as that to which the incoming air is compressed while producing nitrogen at a high pressure, would require the generation of very high pressures in the heat pump circuit. Accordingly, in these circumstances, the heat pump circuit would have a very high power demand and renders the air separation process relatively inefficient.

There is therefore a need for an improved air separation process and apparatus which are capable of operation with a relatively high pressure air feed, which are more flexible in operation that a conventional double column, and which have a reduced requirement for heat pumping work in comparison with a single column.

SUMMARY OF THE INVENTION

According to the present invention, there is provided a method of air separation comprising:

(a) removing carbon dioxide and water vapour from a compressed air feed stream and reducing the temperature of the feed stream to a level suitable for its separation by rectification at cryogenic temperatures;

(b) introducing the air stream into a higher pressure rectification column, providing liquid nitrogen reflux for the higher pressure rectification column, and separating the air therein into oxygen-enriched and nitrogen-enriched fractions;

(c) withdrawing a stream of nitrogen-enriched fluid from the higher pressure column;

(d) withdrawing a stream of oxygen-enriched liquid from the higher pressure column and passing it into a lower pressure rectification column in which it is separated into oxygen and nitrogen fractions;

(e) withdrawing an oxygen stream and a nitrogen stream from the lower pressure rectification column; and (f) operating a heat pump cycle to provide reboil for the lower pressure rectification column and reflux for both rectification columns.

The invention also provides apparatus for separating air, comprising:

(a) a compressor for compressing a feed air stream;

(b) means for separating carbon dioxide and water vapour from the feed air stream;

(c) heat exchange means for reducing the temperature of the air stream to a level suitable for separation by cryogenic rectification;

(d) a higher pressure rectification column in communication with the lower temperature end of a passage through the heat exchange means for the air stream, the higher pressure rectification column having an inlet for liquid nitrogen reflux, an outlet for a nitrogen stream and another outlet for an oxygen-enriched liquid stream;

(e) a lower pressure rectification column having an inlet in communication with the said outlet for the oxygen-enriched liquid stream and having outlets for separate oxygen and nitrogen streams; and (f) a heat pump circuit for producing reboil for the lower pressure rectification column and reflux for both rectification columns.

An advantage of the method and apparatus according to the invention is that the respective operating pressures of the lower and higher pressure rectification columns can be set independently of one another. The operating pressure in the higher pressure column may be set at a pressure in the range 9 to 25 atmospheres, and the operating pressure in the lower pressure column at a pressure in the range of say 2 to 10 atmospheres. Moreover, the liquid/vapour ratio in each column can be set independently of that in the other column. This makes possible relatively efficient operation of the columns irrespective of the chosen operating pressures and offers flexibility in selecting the purity of the oxygen product. Typically an oxygen product containing from 90 to 99% by volume of oxygen is produced. These advantages are not exhibited by a conventional double column arrangement in which the upper end of the higher pressure column is linked thermally by a condenser-reboiler to the lower end of the lower pressure column.

In the event that the air compressor is also employed to feed with air a combustion chamber associated with a gas turbine, a stream of nitrogen from the higher pressure rectification column is preferably supplied to the combustion chamber or to the combustion products leaving the chamber at a region upstream of the turbine. In this way, work may be recovered from the nitrogen. The nitrogen is preferably preheated to above ambient temperature. It is advantageous that the nitrogen is taken from the higher pressure column. This contrasts with the arrangement disclosed in U.S. Pat. No. 4,224,045 in which the corresponding nitrogen stream is taken from the lower pressure column. It is of course possible to recover work from the nitrogen from the higher pressure column in other ways.

The incoming air for separation is preferably purified by removal of carbon dioxide, water vapour and the like, by means of a plurality of molecular sieve beds. The beds may be regenerated using nitrogen from the lower pressure rectification column.

The air stream is preferably cooled in the heat exchange means to a temperature a little above its dew point. Preferably, a second stream of air which has been liquefied is also introduced into the higher pressure rectification column. In addition, it is also preferred to introduce a stream of liquefied air into the lower pressure rectification column. Such introduction of liquid air into the lower pressure column facilitates the attainment of relatively efficient operating conditions within the lower pressure column. Typically, the main air stream provides 70 to 80% of the total amount of air fed to the rectification columns.

The working fluid in the heat pump cycle is preferably nitrogen in which example the cycle may introduce liquid nitrogen to and remove gaseous nitrogen from the lower pressure rectification column. Refrigeration for the process may for example be provided by withdrawing a stream of air from the heat exchange means at a temperature between those of its cold and warm ends, expanding the withdrawn air in a turbine, and introducing the resulting expanded air into the lower pressure column.

The liquid air and oxygen-enriched liquid streams introduced into the lower pressure rectification column are preferably sub-cooled upstream of their introduction into the lower pressure column. In addition, liquid nitrogen reflux to the lower pressure rectification column is preferably also sub-cooled. It is further preferred that the oxygen-enriched liquid from the higher pressure column is, after sub-cooling, divided into two streams, one being introduced into the lower pressure column as liquid and the other being vaporised, for example by heat exchange with a nitrogen stream, and then introduced as vapour into the lower pressure rectification column.

Typically, where the working fluid in the heat pump cycle is nitrogen, a pump is used to introduce the liquid nitrogen reflux from the heat pump cycle into the higher pressure rectification column.

BRIEF DESCRIPTION OF THE DRAWINGS

The method and apparatus according to the present invention will now be described by way of example with reference to the accompanying drawings, in which.

DETAILED DESCRIPTION OF THE INVENTION

Figure 1:
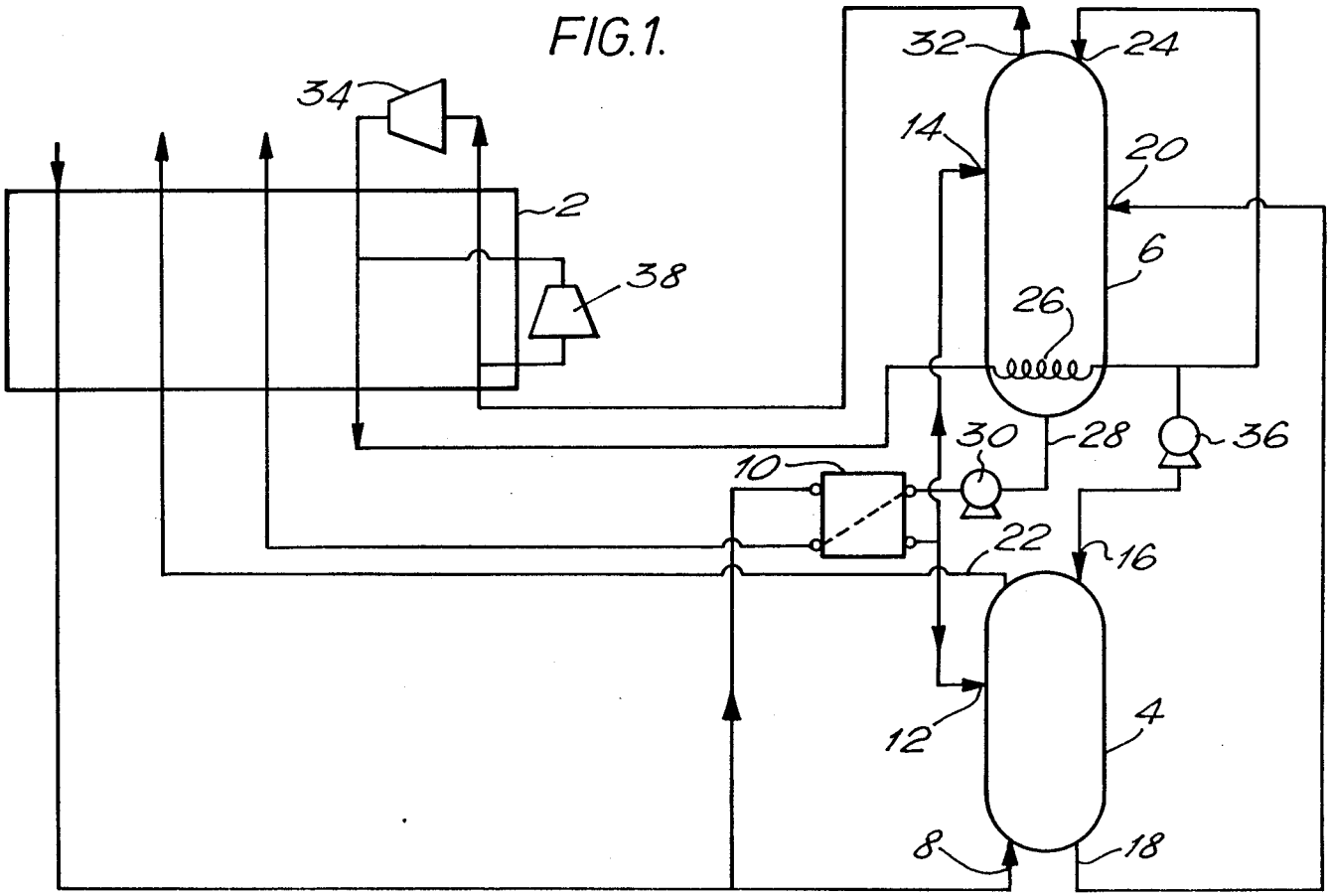
FIG. 1 is a simplified schematic circuit diagram illustrating the invention.

Referring to FIG. 1 of the drawings, compressed air from which water vapour and carbon dioxide have been removed is passed through a heat exchanger 2 and is thereby cooled from ambient temperatures to about its dew point. The thus-cooled air is divided into two streams. A major part of the flow is introduced into a first rectification column 4 through an inlet 8. The remainder of the cooled air is passed through a heat exchanger 10 and is condensed therein. A stream of liquid air leaves the heat exchanger 10. It is divided into two parts of approximately equal size. One part of the liquid air stream is introduced into the rectification column 4 through an inlet 12. The other part of the liquid air stream is introduced into a second rectification column 6 through an inlet 14. The rectification column 6 operates at a lower pressure than that of the column 4.

The first rectification column 4 is provided at its top with an inlet 16 for liquid nitrogen reflux The column is provided with many liquid-vapour contact trays or other devices for effecting contact between the liquid and gaseous phases therein with the result that liquid descending the column becomes progressively richer in oxygen and gas ascending the column becomes progressively richer in nitrogen A .stream of oxygen-enriched liquid is withdrawn from the bottom of the higher pressure column 4 through an outlet 18. The oxygen content of the stream depends on the pressure in the column 4. Typically, at an operating pressure of about 15 atmospheres absolute, the liquid stream contains about 33% by volume of oxygen. Its oxygen content would tend to increase with a choice of a lower operating pressure for the column 4 and decrease with a choice of a higher operating pressure for this column. The oxygen-enriched liquid stream may be sub-cooled (by means not shown in FIG. 1) and then introduced into the lower pressure column 6 through an inlet 20. The higher pressure column 4 also has a stream of nitrogen gas withdrawn from it through an outlet 22 at its top. The nitrogen stream is then warmed to an ambient temperature by passage through the heat exchanger 2 countercurrent to the incoming air stream. This nitrogen stream is produced at a pressure only a little below that at which the column 4 operates and thus it is worthwhile recovering work from this stream by for example expanding it in an expansion turbine (not shown).

The liquid air stream introduced into the lower pressure column 6 through the inlet 14 and the oxygen-enriched liquid stream introduced therein through the inlet 20 are subjected to further separation in this column 6. Liquid nitrogen reflux is introduced to the column 6 through an inlet 24. Like the column 4, the rectification column 6 is provided with many liquid-vapour contact trays of known kind or other liquid-vapour contact means whereby intimate contact between the liquid and vapour phases in the column 6 can be effected. The column 6 is also provided through reboiler 26 with a stream of vapour that ascends the column and contacts a descending stream of liquid and there is a range of compositions within the column extending from a substantially pure nitrogen vapour at the top of the column 6 to a liquid at the bottom of the column 6 typically containing at least 90% by volume of oxygen. A stream of this liquid oxygen is withdrawn from the bottom of the column 6 through an outlet 28 and is pumped by pump 30 through the heat exchanger 10 where it is vaporised by countercurrent heat exchange with the incoming condensing air. The stream now comprising oxygen vapour then flows through the heat exchanger 2 countercurrently to the incoming air stream and may be used in a chemical reaction, for example, in direct reduction steel making or in the gasification of coal.

A stream of nitrogen vapour is withdrawn from the top of the lower pressure rectification column 6 through an outlet 32 at the same rate as the liquid nitrogen is introduced into the column 6 through the inlet 24. The nitrogen vapour stream is then warmed to ambient temperature by passage through the heat exchanger 2 countercurrently to the incoming air stream. The nitrogen stream is compressed in a compressor 34 and passed again through the heat exchanger 2 but this time cocurrently with the incoming air stream. The pressure at which the nitrogen is compressed is selected so as to be such that nitrogen leaving the cold end of the heat exchanger 2 is a vapour at its dew point. The nitrogen stream then flows through the reboiler 26 thus boiling liquid oxygen in the column 6 and at the same time being itself liquified. The resultant stream of liquid nitrogen is then used to form a liquid nitrogen reflux for both the rectification columns 4 and 6. The stream is thus divided and one part is pumped by a pump 36 through the inlet 16 of the rectification column 4, while the other part is sub-cooled (by means not shown) and introduced into the rectification column 6 through the inlet 24.

The withdrawal of the nitrogen vapour stream from the rectification column 6 though the outlet 32, its warming in the heat exchanger 2, its compression in the compressor 34, its reduction in temperature again in the heat exchanger 2, its condensation in the reboiler 26, its reintroduction into the column 6 through inlet 24 and its subsequent change of phase in the column 4 by virtue of mass exchange with an ascending vapour stream constitutes a heat pumping cycle in which, in effect, there is flow of heat from the lower temperature top end of the column 6 to the relatively warm bottom end of the column 6 where the reboiler 26 is located. The amount of nitrogen flowing through this heat pump cycle may be selected so as to give optimum liquid/vapour ratios in both columns 4 and 6. Moreover, unlike a conventional double column, the operating pressures in the two rectification columns 4 and 6 may be set independently of one another. In one example of the operation of the apparatus shown in FIG. 1, the higher pressure column may operate an average pressure of about 15 atmospheres absolute and the lower pressure column 6 may operate at an average pressure of 4 atmospheres absolute. In this example, the compressor 34, typically has an outlet pressure of about 12.8 atmospheres absolute, and the pump 30 may pump the liquid oxygen withdrawn from the lower pressure column 6 up to a pressure of about 6 atmospheres.

It will generally be necessary to provide refrigeration for the heat exchanger 2. There are a number of ways in which this can be done as is well known in the art, and one such way is illustrated in FIG. 1 in the form of an expansion turbine 38 which takes a portion of the compressed nitrogen in the heat pump circuit at the temperature between its inlet temperature 2 and outlet temperature from the heat exchanger 2, and expands the nitrogen to the pressure of the upstream of the inlet to the compressor 34, thereby reducing its temperature.

The nitrogen stream expanded in the turbine 38 is then returned to the heat pump cycle at a location where the temperature of the expanded nitrogen matches that of the stream being warmed in the heat exchanger 2.

Typically, the streams of liquid that are introduced into column 6 pass through expansion valves (not shown) which reduce the pressure of the streams to the operating pressure of the column 6.

Various modifications and additions may be made to the apparatus and method described with reference to FIG. 1. Some of these are described with reference to FIG. 2. Others include the withdrawal of oxygen product from the column 6 as gas, in which example the condenser-reboiler 10 is omitted and no air is introduced into the column 10 in the liquid state.

As aforementioned, the method of air separation is described with reference to FIG. 1 is particularly suited for use in association with the kind of process in which the oxygen is used to take part in a chemical reaction, and heat or a product of the chemical reaction is used to generate electricity. Such a combined process is illustrated in FIG. 2.

Figure 2:
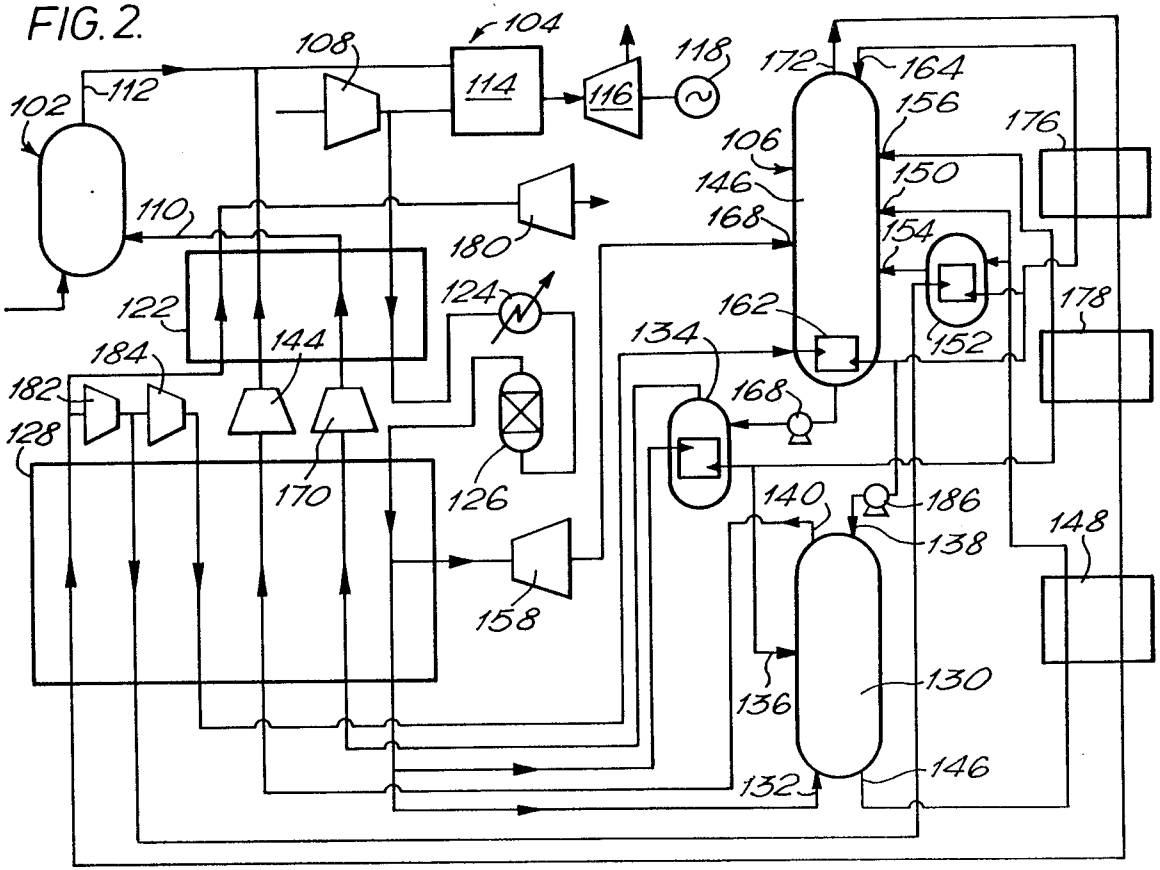
FIG. 2 is a schematic circuit diagram illustrating the integration of apparatus according to the invention into a process which produces both fuel gas and electrical power.

Referring to FIG. 2, there is illustrated apparatus comprising a gasifier or blast furnace 102, a power station 104, and an air separation plant 106. The power station 104 and air separation plant 106 share a common compressor 108.

The gasifier or blast furnace 102 is operated in a conventional manner. Since this aspect of the apparatus shown in FIG. 2 does not form part of the invention, the operation of the gasifier or blast furnace 102 will not be described in detail herein. The air separation plant 106 is employed to provide a product oxygen stream typically containing in the order of 90% by volume of oxygen to the gasifier or blast furnace 102 through an inlet 110. A calorific gas leaves the gasifier or blast furnace 102 through an outlet 112. The fuel gas is burnt in a combustion chamber 114 of a gas turbine 116. Air is supplied from a compressor 108 to support combustion of the fuel gas in the combustion chamber 114. The resulting hot gases pass to the turbine 116 and are expanded therein. The turbine 116 is coupled to an electricity generator 118 and electricity is generated by operation of the turbine 116. The expanded gases leave the turbine 116 through an outlet 120 and may be passed to the waste heat boiler (not shown) to recover heat therefrom.

The compressor 108 is not provided with any aftercooler and therefore the air leaves it at an elevated temperature, for example 360° C. Typically, a major portion of this air stream is supplied to the combustion chamber 114 and only a minor portion (say in the order of 10%) is separated into oxygen and nitrogen.

A minor stream of air is taken from the air compressed in the compressor 108 and is cooled to approximately ambient temperature by passage through a first heat exchanger 122 and then a water cooler 124. The cooled air stream is then passed through a purification unit 126 typically comprising a plurality of beds of zeolite molecular sieve that selectively adsorb water vapour and carbon dioxide from this air stream A purified air stream is then passed through a main heat exchanger unit 128. The air is cooled as it flows through the heat exchanger 128 to an outlet temperature at or approaching closely to its dew point The resulting cooled air stream is then divided into major and minor air streams The major air stream typically comprising some 70–80% of the flow leaving the heat exchanger 128 is introduced into a first rectification column 130 through an inlet 132. The minor stream typically comprising some 20–30% of the air leaving the cold end of the heat exchanger 128 is passed through a condenser-reboiler 134 in which it is liquified. The resulting stream of liquid air is in turn divided into two parts typically of equal size One of these so-formed streams is introduced into the first rectification column 130 through an inlet 136 and the other stream as will be described below is sent to a second rectification column 140 operating at a substantially lower pressure than that of the column 130. The higher pressure rectification column 130 is supplied with a stream of liquid nitrogen reflux through an inlet 138 in the top of the column. The column 130 is provided with liquid/vapour contact means such as trays whereby vapour ascending the column is brought into intimate mass exchange relationship with liquid descending the column. Typically the column may have 40 trays. As the third liquid descends the column so it becomes richer in oxygen and as the vapour ascends the column so it becomes richer in nitrogen. The overall effect of the column 130 is to strip oxygen from the air introduced into it through the inlets 132 and 136 with the result that a relatively pure nitrogen fraction collects at the top of the column 130 while a oxygen-enriched liquid is withdrawn from the bottom of the column 130.

Figure 3:
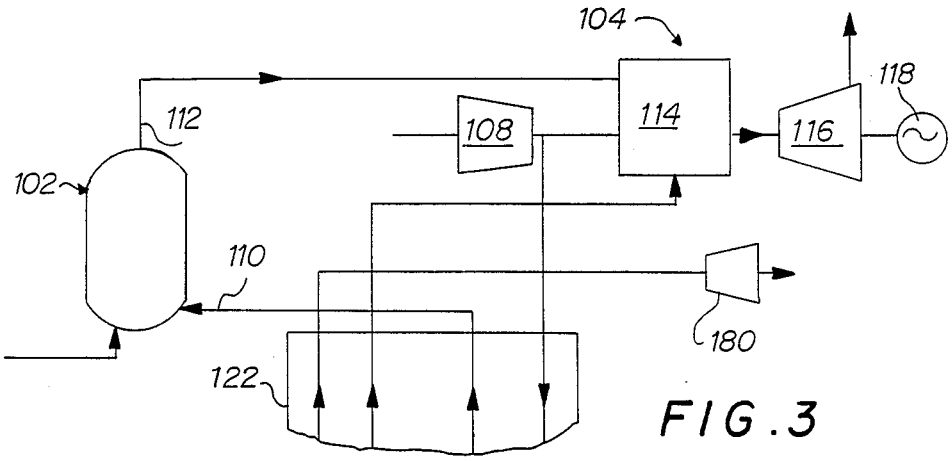
FIG. 3 is a fragmentary view of FIG. 2 illustrating an alternative embodiment of the apparatus shown therein.
Figure 4:
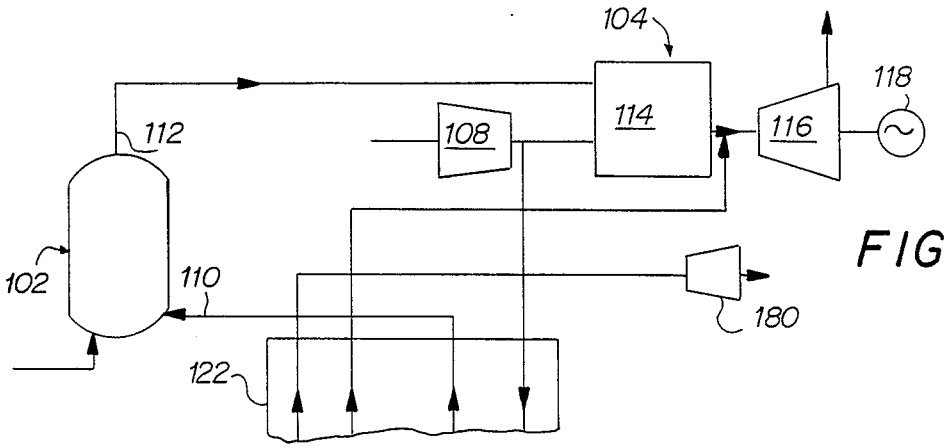
FIG. 4 is a fragmentary view of FIG. 2 illustrating another alternative embodiment of the apparatus shown therein.

Two streams are withdrawn from the column 130. First, a gaseous nitrogen stream is withdrawn from the top of the column 130 through an outlet 140. The nitrogen is then passed through the heat exchanger 128 countercurrently to the air stream and is thereby warmed to about ambient temperature. Work is recovered from this nitrogen stream in the turbine 116. Accordingly, the ambient temperature nitrogen is passed through the heat exchanger 122 countercurrently to the air flow to raise its temperature above ambient temperature and then the nitrogen may be mixed with the fuel gas stream and passed to the combustion chamber 114, as illustrated in FIG. 3, introduced directly into the combustion chamber 114 and/or as illustrated in FIG. 4, introduced into the hot gases leaving the combustion chamber 114 at a region upstream of the turbine 116.

Employing the nitrogen in the combustion chamber 114 helps to reduce the formation of NOx in the combustion chamber 114. If desired, the nitrogen can be heated above the temperature at which it leaves the heat exchanger 122 by, for example, waste heat extracted from the gasifier or blast furnace 102. In addition, if the nitrogen is at a pressure below that at which the combustion chamber 114 operates it may be compressed to the appropriate pressure in a compressor 144. However, since the higher pressure column 130 operates at almost the pressure of the compressor 108, the amount of compression that needs to be performed by the compressor 144 is typically only that which is required to make up for pressure drop.

The second stream withdrawn from the rectification column 130 is an oxygen-enriched liquid stream typically containing about 33% by volume of oxygen. This is withdrawn through an outlet 146 at the bottom of the column, is sub-cooled in a heat exchanger 148 and is then divided into two streams. The major stream is introduced as liquid into the lower pressure rectification column 140 through an inlet 150. The minor stream is vaporised in a condenser-reboiler 152 and the resultant vapour is passed as a stream into the column 140 through an inlet 154.

In addition to the streams of oxygen-enriched air introduced into it, the rectification column 140 also receives one of the two streams of liquid air from the condenser-reboiler 134. In addition, it receives a stream of air (typically about 8% of the total air flow into the heat exchanger 128) which is withdrawn from an intermediate region of the heat exchanger 128 and is expanded in an expansion turbine 158 to the operating pressure of the column 140, the air leaving the expansion turbine 156 at or near to its dew point. This stream of air is then introduced into the lower pressure rectification column 140 through an inlet 160.

In order to separate the various air streams introduced into the rectification column 140, the column is provided with a condenser-reboiler 162 at its bottom and an inlet 164 for liquid nitrogen reflux at its top. The column additionally has a large number of trays (for example, 70) or other liquid-vapour contact means whereby ascending vapour could be brought into contact with descending liquid and exchange matter therewith. Accordingly, the air is separated in the column 140 into an oxygen fraction at the bottom of the column and a nitrogen fraction at the top of the column. Liquid oxygen is withdrawn from the bottom of the column through an outlet 166 by pump 168 and it is this stream of liquid oxygen that condenses the air in the condenser-reboiler 134, being at least partially reboiled itself. The resulting oxygen stream passes from the condenser-reboiler 134 through the heat exchanger 128 countercurrently to the incoming air stream. The oxygen is then compressed in a compressor 170 to raise it to a pressure suitable for its introduction into the gasifier or blast furnace 102, though if the rectification column 140 operates at a high enough pressure the compressor 170 may be omitted. The compressed oxygen stream is then typically warmed to above ambient temperatures by passage through the heat exchanger 122 countercurrently to the incoming air. The oxygen may then be introduced into the gasifier or blast furnace 102 through the inlet 110.

A stream of nitrogen vapour is withdrawn from the top of the rectification column 140 through the outlet 172 The stream of nitrogen 172 is then passed through a heat exchanger 174 which is employed to sub-cool the stream of liquid nitrogen introduced into the column 140 through the inlet 164 as reflux. The nitrogen stream is then passed through a heat exchanger 178 which is employed to sub-cool liquid air that is introduced into the rectification column 140 through the inlet 156. The nitrogen then passes through the heat exchanger 148. The nitrogen stream is thus able to provide refrigeration for the heat exchangers 148, 176 and 178. The stream of nitrogen is then passed through the heat exchanger 128 countercurrently to the incoming air flow. It is thus warmed to approximately ambient temperatures. The nitrogen stream is then split. A minor portion of it is passed through the heat exchanger 122 countercurrently to the incoming air and is thus warmed to a temperature well above ambient. It is then expanded in expansion turbine 180 with the performance of external work (the turbine 180 may for example be used to drive the compressor 144) and the resulting expanded nitrogen stream may be used in a manner well known in the art to purge carbon dioxide and water vapour from the adsorbent beds of the purification unit 126.

The remainder of the nitrogen stream leaving the heat exchanger 128 at approximately ambient temperature is compressed in a compressor 182. This nitrogen stream is then split again. The major part of this is further compressed in a compressor 184.

If desired, the compressors 182 and 184 may simply be different stages of a multi-stage compressor. The nitrogen stream leaving the compressor 184 is then cooled by passage through the heat exchanger 128 cocurrently with the incoming air stream. It is then passed through the condenser-reboiler 162, being itself condensed and providing reboil for the lower pressure rectification column 140. The resultant liquid nitrogen stream is withdrawn from the condenser-reboiler 162 and is passed through the heat exchanger 176, thereby being sub-cooled. It is then introduced into the rectification column 140 at the operating pressure of the column through the inlet 164 and provides reflux for the column. The nitrogen thus flows around the circuit in which it does heat pumping work for the column 140. In addition, a pump 186 is operated so as to withdraw some of the liquid nitrogen leaving the condenser-reboiler 162 and introduce it as reflux into the higher pressure rectification column 130 through the inlet 138.

The rest of nitrogen leaving the compressor 182 does not flow through the compressor 184 but is instead returned directly through the heat exchanger 128 flowing co-currently with the incoming air stream. The resulting cooled nitrogen is then passed through the condenser-reboiler 152, being itself condensed and reboiling the stream of oxygen-enriched liquid that is passed through the condenser-reboiler 152. The resulting liquid nitrogen is united with the stream of liquid nitrogen leaving the condenser-reboiler 152 at a region upstream of the entry of the nitrogen into the heat exchanger 176.

It is to be appreciated that liquid streams are introduced into the column 140 through expansion valves (not shown) or like means so as to reduce the pressure at which they are introduced to the pressure in the column 140.

Various changes and modifications may be made to the apparatus shown in FIG. 2. For example, the air stream leaving the purification unit 126 may be divided into major and minor streams upstream of the heat exchanger 128 rather than in the heat exchanger 128 itself. The minor stream may then be compressed in an additional compressor, then cooled in the heat exchanger 128, withdrawn from the heat exchanger 128 at a temperature intermediate its warm and cold end temperatures and then expanded in the turbine 158. The resulting air stream is then passed to the column 140 as shown in FIG. 2. The additional compressor may if desired be driven by the turbine 158. Also, alternative methods of regenerating the purification unit 126 may be employed. For example, all the nitrogen product may be taken from the higher pressure column 130, that is to say no stream of lower pressure nitrogen is taken for regeneration of the molecular sieve beds of the purification unit 126 from intermediate the warm end of the heat exchanger 128 and the inlet to the compressor 182, and some of the higher pressure nitrogen stream may be used to regenerate the purification unit 126. In this way, the rate at which nitrogen is passed to the turbine 116 can be maximised. It is also appreciated that there are many additional or alternative ways of providing refrigeration for the process. Since nitrogen passes through the nitrogen heat exchange unit 128 at four different pressure levels, expansion of nitrogen in a turbine between any two of them affords an opportunity to provide net refrigeration for the process.

I claim:

1. A method of air separation comprising:

(a) removing carbon dioxide and water vapour from a compressed air feed stream and reducing the temperature of the feed stream to a level suitable for its separation by rectification at cryogenic temperatures;

(b) introducing the air stream into a higher pressure rectification column, providing liquid nitrogen reflux for the higher pressure rectification column, and separating the air therein into oxygen-enriched and nitrogen-enriched fractions;

(c) withdrawing a stream of nitrogen-enriched fluid from the higher pressure column;

(d) withdrawing a stream of oxygen-enriched liquid from the higher pressure column and passing it into a lower pressure rectification column in which it is separated into oxygen and nitrogen fractions;

(e) withdrawing an oxygen stream and a nitrogen stream from the lower pressure rectification column; and (f) operating a heat pump cycle to provide reboil for the lower pressure rectification column and reflux for both rectificatiion columns.

2. The method of claim 1 wherein an air compressor is used both to compress the air to be separated and to feed compressed air to a combustion chamber associated with a gas turbine employed in the production of electricity, and in which a stream of nitrogen from the higher pressure rectification column is supplied to one of the combustion chamber and the combustion products at a region upstream of the turbine, whereby work can be recovered from the nitrogen.

3. The method of claim 2 wherein the nitrogen is heated to above ambient temperature upstream of the combustion chamber.

4. The method of claim 3 wherein the electricity produced exceeds the requirements of the air separation method for electricity.

5. The method of claim 4 wherein in the liquefied air is introduced into the higher pressure column.

6. The method of claim 4 wherein the liquefied air is introduced into the lower pressure column.

7. The method of claim 4 wherein a stream of cooled air is expanded in an expansion turbine, and the resulting expanded air stream is introduced into the lower pressure column.

8. The method of claim 4 wherein each liquid stream introduced into the lower pressure rectification column is, upstream of the lower pressure rectification column, sub-cooled and then adjusted in pressure to that of the column.

9. The method of claim 8 wherein the stream of oxygen-enriched liquid, after sub-cooling, is divided into two streams, one of which is introduced into the lower pressure column as liquid, the other being vaporised and then introduced as vapour into the lower pressure column.

10. The method of claim 9 wherein said other oxygen-rich liquid stream is vaporised by heat exchange with a nitrogen stream.

11. The method of claim 8 wherein the working fluid in the heat pump cycle is nitrogen and wherein the cycle includes introducing liquid nitrogen into and withdrawing gaseous nitrogen from the lower pressure rectification column.

12. The method of claim 8 wherein the operating pressure of the higher pressure column is in the range to 9 to 25 atmospheres absolute.

13. The method of claim 8 wherein the operating pressure of the lower pressure column is in the range 2 to 10 atmospheres absolute.

14. An apparatus for separating air comprising:

(a) a compressor for compressing a feed air stream;

(b) means for separating carbon dioxide and water vapour from the feed air stream;

(c) heat exchange means for reducing the temperature of the air stream to a level suitable for separation by cryogenic rectification;

(d) a higher pressure rectification column in communication with the lower temperature end of a passage through the heat exchange means for the air stream, the higher pressure rectification column having an inlet for liquid nitrogen reflux, an outlet for a nitrogen stream and another outlet for an oxygen-enriched liquid stream;

(e) a lower pressure rectification column having an inlet in communication with the said outlet for the oxygen-enriched liquid stream and having outlets for separate oxygen and nitrogen streams; and (f) a heat pump circuit for producing reboil for the lower pressure rectification column and reflux for both rectification columns.

15. The apparatus of claim 14, further comprising a gas turbine including a combustion chamber having an inlet communicating with the air compressor and an outlet, an alternator for generating electricity adapted to be driven by the gas turbine, and a conduit for high pressure nitrogen gas from the higher pressure rectification column communicating with one of the inlet and the outlet of the combustion chamber.

16. The apparatus of claim 15, further comprising a means for heating the nitrogen in said conduit to above ambient temperature.

17. The apparatus of claims 14, wherein the higher pressure column has an inlet for liquefied air.

18. The apparatus of claim 14, wherein the lower pressure column has an inlet for liquefied air.

19. The apparatus of claims 14, further comprising an expansion turbine having an inlet communicating with an air passage through said heat exchange means at an intermediate temperature thereof, and an outlet communicating with the lower pressure rectification column.

20. The apparatus of claim 14, wherein each inlet for a liquid stream into the lower pressure rectification column has a pressure-reduction (or expansion) valve communicating on its inlet side with a passage through a heat exchanger for sub-cooling the liquid.

21. The apparatus of claims 14, further comprising a heat exchanger for sub-cooling the oxygen-enriched liquid stream, and another heat exchanger for vaporising part of the stream, the lower pressure column having an inlet communicating with a passage in said another heat exchanger for said vaporised part.

22. The apparatus of claim 14, wherein which the heat pump circuit includes an outlet from the lower pressure rectification column for nitrogen gas and an inlet to the lower pressure rectification column for liquid nitrogen.

* * * * *